United States Patent [19]

Schweitzer

[11] Patent Number: 4,738,212

[45] Date of Patent: Apr. 19, 1988

[54] BODY SAILER

[75] Inventor: Chris M. Schweitzer, Miami, Fla.

[73] Assignee: Scheelor Marine, Inc., Coral Gables, Fla.

[21] Appl. No.: 917,063

[22] Filed: Oct. 9, 1986

[51] Int. Cl.[4] ..... B63B 35/00

[52] U.S. Cl. ..... 114/39.1; 114/61; 114/339

[58] Field of Search ..... 114/39, 61, 90, 91, 114/123, 283, 107, 331, 315, 339; 441/55

[56] References Cited

U.S. PATENT DOCUMENTS

| | | | |
|---|---|---|---|
| 744,590 | 11/1903 | Moore | 114/123 |
| 2,948,247 | 8/1980 | Rebikoff | 114/313 |
| 4,259,917 | 4/1981 | Frank | 114/91 |

FOREIGN PATENT DOCUMENTS

| | | | |
|---|---|---|---|
| 3031724 | 4/1982 | Fed. Rep. of Germany | 114/107 |
| 1050963 | 1/1954 | France | 441/55 |
| 340724 | 10/1959 | Switzerland | 441/55 |
| 2087787 | 6/1982 | United Kingdom | 114/61 |

*Primary Examiner*—Sherman D. Basinger

*Assistant Examiner*—Jesüs D. Sotelo

*Attorney, Agent, or Firm*—Cushman, Darby & Cushman

[57] ABSTRACT

A body sailer allows an operator to sail in a partially submerged position. The body sailer includes first and second buoyancy pontoon devices held in a spaced apart relationship by a frame. The frame is coupled to a third buoyancy device disposed advanced from the first and second buoyancy pontoon devices in a forward sailing direction. The operator may be supported by a harness between the first and second buoyancy pontoon devices and astern of the third buoyancy pontoon device. The body sailer includes a hand grip mounted underwater to the third buoyancy pontoon device. The third buoyancy pontoon device is articulatable in yaw and pitch with respect to the first and second buoyancy pontoon devices. A mast with a retractable sail may be coupled to the frame. Rudders are coupled to the first and second buoyancy pontoon devices and move in a response to movement of the third buoyancy pontoon device. The craft may be submersible with diving/-climbing controls and submerging/resurfacing apparatus.

28 Claims, 5 Drawing Sheets

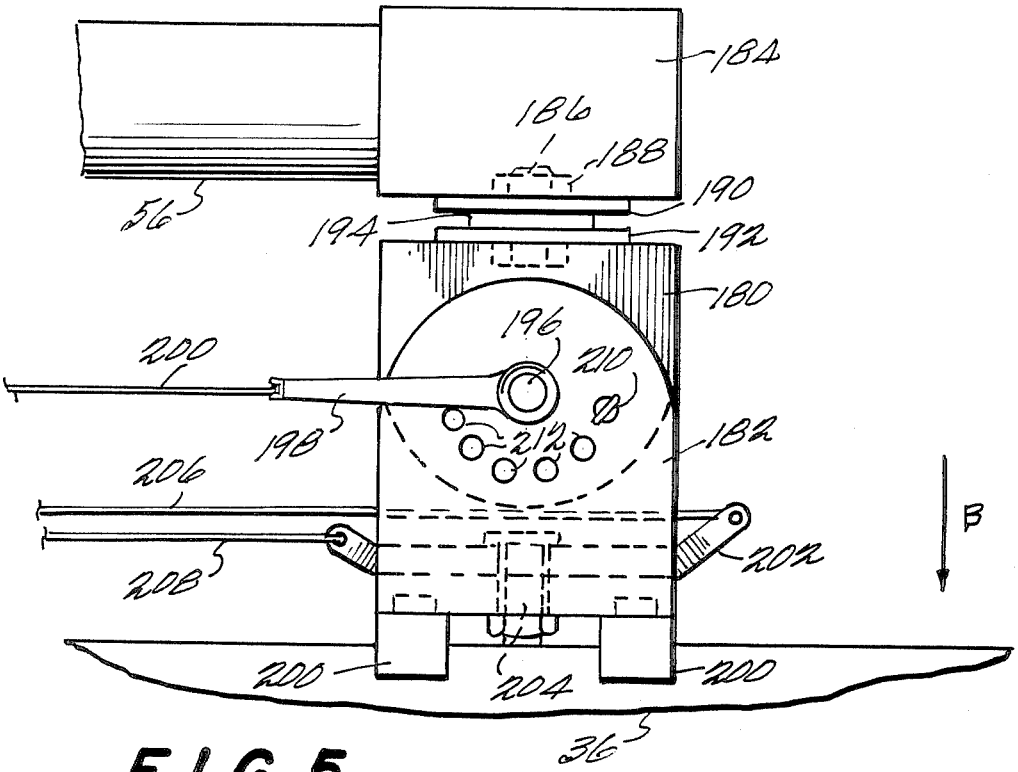
FIG. 5
FIG. 6
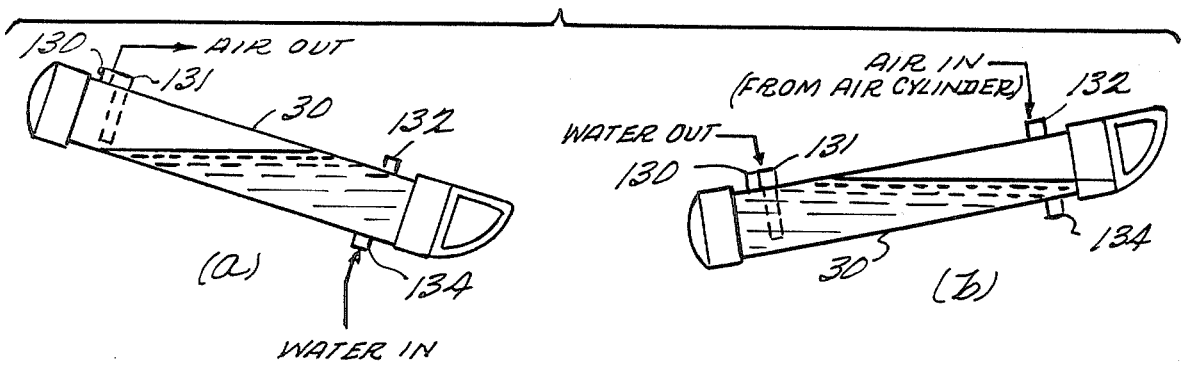

BODY SAILER

BACKGROUND OF THE INVENTION

This invention relates to sailing devices, and more particularly to a sailing device in which the operator is supported in a semi-submerged position.

The field of sailing ships is rather well developed. Known are schooners, ketches, yawls, single-mast sailing ships, catamarans, and other well-known sailing ships. Inherent in the design of all such known sailing ships is that the operator is supported above the water in a position to operate all sailboat equipment. A disadvantage of such a design is that the operator is precluded from carefully observing activities underneath the surface of the water. For example, fisherman, artifact-hunters, wildlife observers, and other underwater observers are precluded from operating a known sailboat and at the same time observing subsurface objects.

In addition, all known sailboats are steered by a rudder-tiller assembly coupled near the stern of the ship. While this known configuration is acceptable for many sailing purposes, an articulated boat with rudders would provide more instantaneous steerage control to the craft. A forward articulated portion could turn at the same time as the rudders, thereby providing additional surface area to deflect the oncoming water, thus providing additional steerage control. Such additional steerage control is important when sailing speeds are low and/or when radical turns are required within a short distance, for example, when floating on the surface and observing underwater activity.

Finally, no known sailboats are submersible so that the operator may travel on the surface viewing underwater activity, loiter on the surface to more carefully observe underwater activity, submerge and dive to an underwater area of interest, and then resurface and continue to sail. Such a submersible sailboat would be ideal for underwater artifact hunters, fisherman, and any other recreational uses imaginable.

Therefore, there is a need for a sailing device in which the operator may be supported in a semi-submerged position. In addition, such a sailing device should include an articulation joint whereby a forward portion of the craft is made articulatable with respect to the rear portion of the craft. Finally, such a device could be made submergible to further increase the utility of such a craft.

SUMMARY OF THE INVENTION

The present invention is designed to overcome the disadvantages of known sailboats. Specifically, the present invention provides first, second and third pontoon devices coupled together with a frame. The first and second pontoon devices are held in a spaced-apart relationship by the frame. The third pontoon device is coupled forward of the first and second pontoon devices, substantially midway therebetween. Thus, an operator position is provided astern of the third pontoon device yet inbetween the first and second pontoon devices. The frame includes a harness support which supports the operator in a semi-submerged position. Thus, the operator may observe underwater and above water activity by merely moving his/her head.

The frame may include an articulation joint so that the third buoyancy device is articulatable in yaw and pitch with respect to the first and second pontoon devices. The stern end of the third buoyancy device may be provided with underwater hand grip means so that the operator can grip the third buoyancy device underwater.

For steerage control, the stern ends of the first and second bouyancy devices may be coupled to first and second rudders. Cables may be coupled from each rudder to the articulation joint so that the operator may control the first and second rudders by merely manipulating the third buoyancy device with a yaw aticulation.

Coupled to the frame, in proximity to the operator's head, a mast support device may be provided. A mast may be coupled to the mast support device to provide propulsion to the craft. In the preferred embodiment, the mast has a hinge so that it can be collapsed for submerged operations. Also, the mast may be equipped with a retractable sail so that the sail may be furled prior to submerged operations.

The preferred embodiment may include apparatus for submerging and resurfacing the body sailer. Such means may include, in each pontoon device, a water inlet, a water outlet, a pressurized gas inlet, and a gas outlet for controlling the ballast of each pontoon device. Selected portions of each pontoon device may be flooded to submerge the craft. A pressurized gas container may be provided to supply pressurized gas to the submerged pontoon devices to cause them to regain buoyancy, thus resurfacing the body sailer. A forward dive/climb plane may be coupled to the hand grip to control the diving and climbing motion of the craft. In addition, rear climbing/diving planes may be coupled to the outside portion of the first and second pontoon devices.

BRIEF DESCRIPTION OF THE DRAWINGS

The advantageous structure and features of the present invention will become more clear after a reading of the following detailed description of the presently preferred exemplary embodiment, when taken together with the attached drawings which show:

FIG. 5 is a side view of the articulation joint with aft rudder control cables and aft dive/climb plane control cables; and FIG. 6 is a schematic drawing of one of the buoyancy pontoons depicting the ballast control.

DETAILED DESCRIPTION OF THE PRESENTLY PREFERRED EXEMPLARY EMBODIMENT

Figure 1:
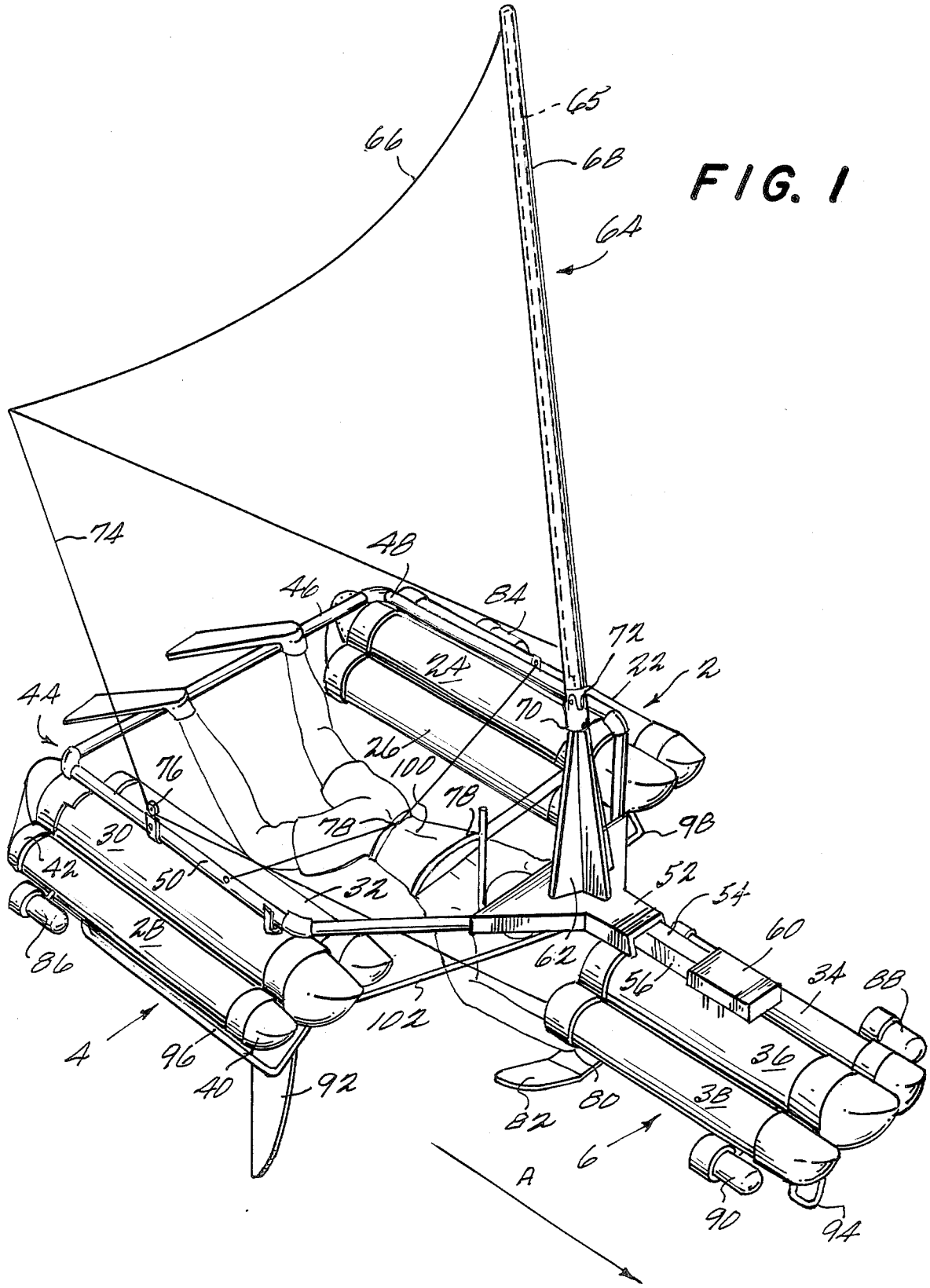
FIG. 1 is a perspective view of the presently preferred exemplary embodiment.

The body sailer is a lightweight, modular sailboat designed to allow the operator to easily observe above water and underwater activities. From a semi-submerged operator's position, the operator may control the steering apparatus and the sail apparatus to provide positive sailing control. The body sailer includes a number of lightweight PVC components so that the craft may be easily transported yet is very durable to exposure to wind and water. In addition, the body sailer may be assembled and disassembled in modules for ease of transportation. In addition, the modular architecture allows for easy repair and/or replacement of damaged parts. Finally, the unique architecture of the body sailer provides a craft uniquely adapted for sailing on the surface while observing underwater activity, loitering at a particular spot on the surface, diving to investigate underwater activity, and resurfacing at the conclusion of underwater investigations. The body sailer apparatus is thus uniquely designed to provide long duration water activities. By allowing the operator to float on the surface for extended periods of time, and when to dive to selected locations when required, the present invention significantly extends the time duration of a given water activity, thus increasing the distance over which a water activity may be performed.

The unique advantages of the body sailer are thus well adapted for underwater search activities. Since the operator may spend a good deal of time in near proximity to the surface, extensive breathing gases need not be provided. Any underwater breathing tanks need only be used during the short periods of time in which the craft is submerged. The sail power of the craft reduces the requirement for heavy propulsion means and provides a slower craft speed, uniquely suited for underwater search activities.

The unique articulation apparatus according to the present invention provides extremely sensitive steerage control and allows the operator to follow underwater activity or loiter thereabove.

Finally, the submerging/resurfacing apparatus according to the present invention allows the body sailer to be quickly and safely submerged and resurfaced at the operator's command.

While the present invention will be described with what is presently believed to be the most practical and preferred embodiments, those of ordinay skill in this field will understand that the teachings of this invention may be adapted and modified for many types of sailing craft. All such modifications and adaptations are intended to be included within the scope of the protection claimed in the appended claims. In addition, those of ordinary skill in this field will recognize other advantages and functions of the presently claimed invention which may not have been fully elucidated in the specification. Again, it is to be understood that all such advantages inherent in the structure of this invention are to be afforded protection, as consonant with the scope of the appended claims.

Referring now to FIG. 1, a perspective view of the body sailer is depicted. The body sailer includes a port buoyancy pontoon device 2, a starboard buoyancy device 4, and a forward pontoon buoyancy device 6. Each pontoon buoyancy device may include threee buoyancy pontoons. For example, pontoon device 2 may include an outboard pontoon 22, a central pontoon 24, and an inboard pontoon 26. Likewise, right pontoon device 4 may include outboard pontoon 28, central pontoon 30, and inboard pontoon 32. In the same fashion, front pontoon device 6 may include a left pontoon 34, a central pontoon 36, and a right pontoon 38. Each separate pontoon may be constructed from tubular PVC plastic stock, rolled sheet metal, composite materials, or other marine stock such as aluminum or stainless steel. Those of skill in this field will understand that a wide variety of materials may be used to construct each pontoon.

As depicted in FIG. 1, each pontoon includes a bow cap and a stern cap. As an example only, outboard pontoon 28 may include bow cap 40 and stern cap 42. In a like manner, the other pontoons also may include bow and stern caps. As shown more clearly in FIGS. 3 and 4, the bow caps of the pontoons may be specially configured to reduce water drag. In addition, the shape of the bow caps may be configured so as to provide great durability when beaching the craft or impacting its bow end with the sea floor. In addition, the bow and end caps of each pontoon may be made removable to improve disassembly and maintenance and repair. In addition, each outboard pontoon 22, 28, 34, and 38 may have electric batteries disposed therein in order to provide electric energy to electric motors to be discussed below.

Also depicted in FIG. 1 is frame 44. Frame 44 may include rear frame portion 46, part side frame portion 48, starboard side frame portion 50, collar 52, forward frame portions 54, 56 and universal joint 60. The frame members may be constructed from tubular PVC plastic stock. However, those of skill in this field will understand that the frame could be made from rectangular, I-beam, or other shaped members constructed of any marine use material such as aluminum or stainless steel.

The various frame members may be held together by removable locking pins threaded sleeves or other temporary coupling devices to improve the modular nature of the body sailer. The fore ends of frame members 48 and 50 are held together by being enclosed within a removable collar 52. Again, frame members 48 and 50 may be coupled to removable collar 52 through locking pins to aid in assembly and disassembly of the body sailer. The collar 52 may be made from flat marine stock of appropriate strength and rigidity. The uppermost surface of the collar 52 serves as a platform onto which a mast step 62 is attached. The mast step 62 comprises a tubular section of marine stock upon which three abutment sections (only two are shown in FIG. 1) are attached.

FIG. 1 also depicts mast 64 and sail 66. Mast 64 may include an upper portion 68 and a lower portion 70. Mast lower portion 70 may be temporarily or permanently fixed to mast step 62.

Between upper mast portion 68 and lower mast portion 70 is a hinge 72. Hinge 72 allows upper mast portion 68 to articulate with respect to lower mast portion 70. In addition, hinge 72 may include locking pins and gaskets especially configured to allow the two portions of the mast to be disassembled. Thus, hinge 72 in mast 64 improves assembly/disassembly, transportation, and the capability of the craft to be submerged (to be discussed below).

Sail 66 may be coupled to mast 64 in any well-known manner. However, should the craft be used as a submersible vessel, it is preferable that sail 66 is of the type which may be automatically furled. Specifically, it is preferable that sail 66 has the capability to be automatically deployed and undeployed from mast 64. Such structures are known in the sailing field and may include, for example, a hollow mast 64 into which the sail is furled by automatic winding devices such as 65 (for example, the automatically deployed sail may include a Stoway Mast TM from Hood Sailmakers, Inc.). As another example, mast 64 may include automatic rotation means so that sail 66 is automatically wrapped around mast 64 as the mast rotates. The provision of an automatically deploying sail allows great flexibility to the operation in adjusting the deployed sail size, and in configuring the craft for submerged operations.

Attached to the foot of sail 66 is mainsheet 74. Mainsheet 74 is routed to the operator position through well known blocks 76 which may, for example, be coupled to one of the frame members of frame 44.

FIG. 1 also depicts operator 100 supported in an operator's position by harness 78. The operator position is in between left pontoon device 2 and right pontoon device 4, but astern of forward pontoon device 6 with reference to forward sailing direction A. Harness 78 supports the operator in a semi-submerged position so that the operator can easily observe above water and below water activities. Also, harness 78 serves to hold the operator in position while he/she is manipulating forward pontoon device 6, and other control devices to be described below. Harness 78 may include chest and wait harnesses which may be coupled to left frame portion 48, right frame portion 50, and/or mast step 62. Harness 78 may be constructed of nylon or other appropriate marine material. Those having skill in this field will understand that a wide variety of means may be providing for supporting the operator in the operator position. The important feature is that the operator be supported at the operator position so as to be enabled to observe above water and below water activities.

For steerage control of the craft, an operator hand grip 80 may be coupled to the bottom or forward pontoon device 6. Hand grip 80 is positioned to be below the surface of the water so that the operator hand grip is submerged. By manipulating hand grip 80, operator 100 may articulate forward pontoon device 6 in yaw or pitch with respect to the rest of the craft. Thus, articulation joint 60 may provide means for permitting yaw and/or pitch articulation of forward pontoon device 6. A more detailed description of articulation joint 60 will be provided below.

To the bottom of hand grip 80 may be coupled a forward dive/climb plane 82. This may be used to control diving/climbing of the craft when submerged. The craft also may include left and right rear dive/climb planes, to be discussed below.

Also depicted in FIG. 1 are electric motors 84, 85, 88, and 90. The electric motors may provide propulsion to the submerged vehicle and/or auxiliary propulsion to the surfaced craft. As was discussed above, electric power for the electric motors may come from batteries (not shown) stored within the outboard pontoons. The electric motors may include any well-known marine propulsion motors, for example, single pitch, variable pitch, multi-speed, reverse, electric motors.

FIG. 1 also depicts starboard center board (or leeboard) 92. Leeboard 92 may be coupled to starboard pontoon device 4 so as to provide greater stability to the sailing craft. The functions of such leeboards are fairly well-known in the sailing field. The present invention includes a hinged leeboard 92 (to be more fully discussed below). The hinged leeboard 92 may be rotated between a horizontal and a vertical position. In the horizontal position, leeboard 92 is stored for submerged operations, transportation, or shallow-water sailing. In the vertical position, leeboard 92 is fully extended to provide enhanced stability to the body sailer.

Finally, FIG. 1 depicts rails used to protect the craft when beaching or when contacting underwater obstacles. For example, bow rail 94 may comprise tubular steel (or other suitable material) to properly protect the bow of the craft when impacting the beach or any underwater obstacle. In a like manner, starboard rail 96 may protect starboard pontoon device 4, while port rail 98 may protect port pontoon device 2. Operator rail 102 may be configured to provide protection to the operator from underwater obstacles, and to enhance the structural stability and firmness of the craft.

Figure 2:
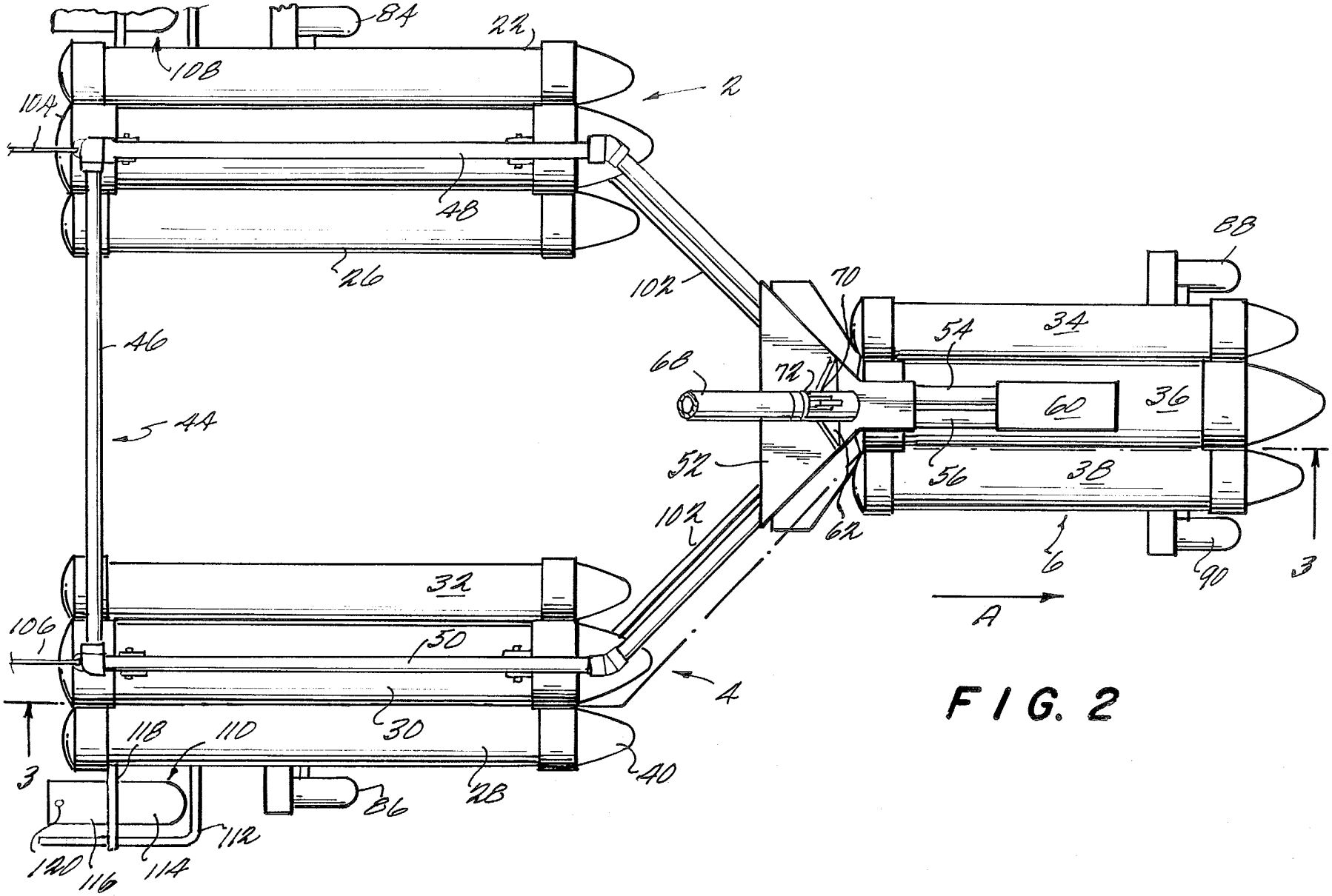
FIG. 2 is a plan view of the embodiment according to FIG. 1.

Turning now to FIG. 2, a plan view of the body sailer is provided. The same reference numerals are used in FIG. 2 to represent the same components as described with reference to FIG. 1. Also depicted in FIG. 2 is port rudder 104 and starboard rudder 106. Rudders 104 and 106 may be coupled to frame 44 with hinges and lock pins. Thus, rudders 104 and 106 may be disassembled and removed from the craft. The attachment and configuration of rudder support devices are fairly well developed and will thus not be described further.

Also depicted in FIG. 2 are port, rear dive/climb plane 108, and starboard, rear dive/climb plane 110. Each rear dive plane is mounted to the after section of the outboard pontoons 22, and 28, respectively. These aft dive/climb planes may be mounted astern of electric motors 84, and 86, respectively. However, persons of skill in this field will understand that any convenient positioning of the rear dive/climb planes may be used. For example, the rear dive/climb planes 108, 110 may be positioned forward of electric motors 84, and 86 with respect to forward sailing direction A. Dive/climb planes 108 and 110 may be used to control diving and climbing of the submerged vehicle, to be discussed below.

Each rear dive/climb plane 108, 110 may include support rail 112 which acts to support the dive/climb plane and to protect it from underwater obstacles. Dive/climb plane 110 may include a fixed plane portion 114 and a movable plane portion 116. Fixed plane portion 114 remains substantially horizontal to provide laminar flow thereover. Movable plane portion 116 is articulatable with respect to the fixed plane portion 114 to provide the actual control surface. Support member 118 may be provided between fixed plane portion 114 and movable plane portion 116 to provide the articulation therebetween. Movable plane portion 116 may include a cable connection coupling 120 which is used to connect a cable (to be discussed below) below movable plane portion 116 and articulation joint 60.

Figure 3:
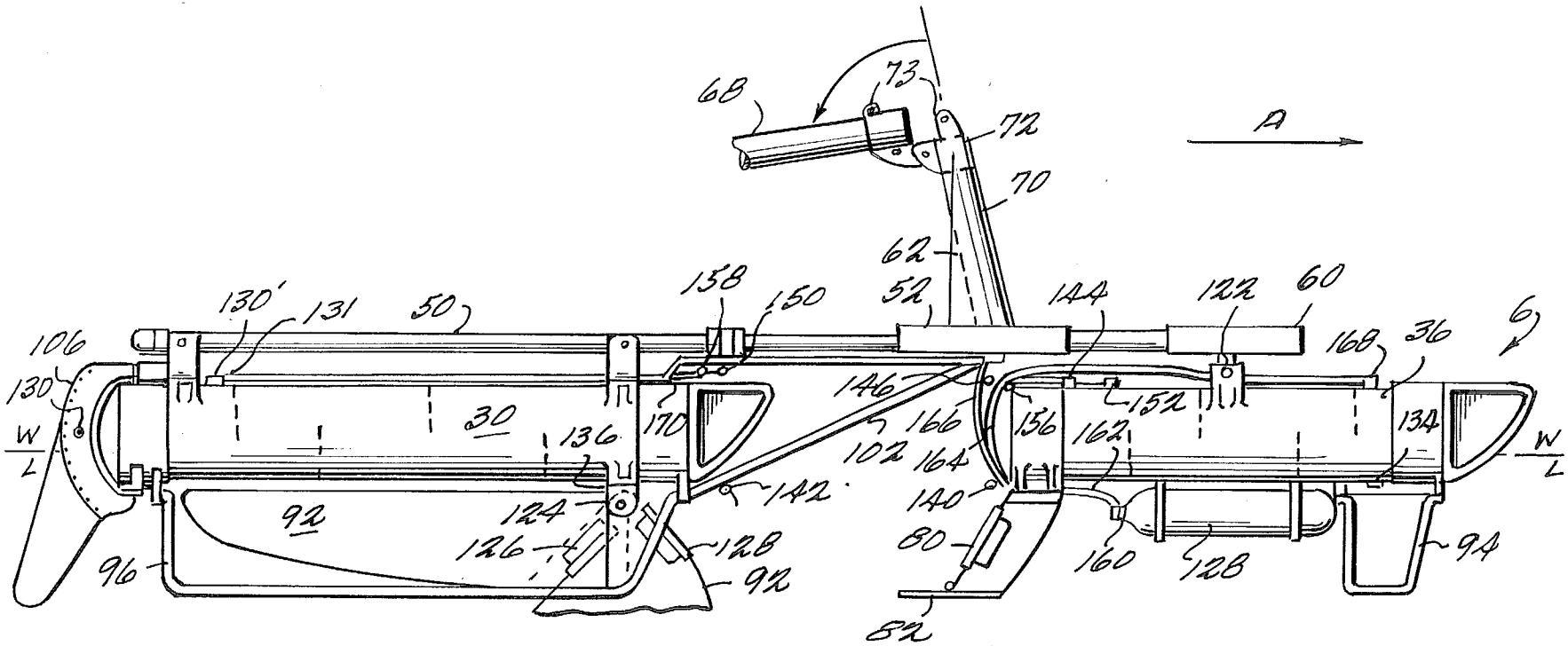
FIG. 3 is a partial-side view of the FIG. 1 embodiment taken along line 3—3 of FIG. 2.

FIG. 3 depicts a partial side view of the body sailer taken along line 3—3 of FIG. 2. Thus, FIG. 3 does not depict outboard pontoon 28 or outboard pontoon 38. Note the waterline axis W/L which depicts the approximate waterline of the floating craft. As in FIG. 2, the reference numerals used in FIG. 3 correspond to the same components as identified with respect to FIGS. 1 and 2.

FIG. 3 provides a close-up view of mast hinge 72. As depicted therein, hinge 72 may include a band of heavy gauge metal the after ends of which extend out past lower mast portion 70. The extended portion of the band contains a hole to which a tubular sleeve is placed to act as a hinge. In a like manner, a band of heavy gauge metal may be wrapped around upper mast portion 68 to cooperate with the band of metal wrapped around lower mast portion 70. As shown in FIG. 3, hinge 72 may include lock pin sleeves 73 in both the upper and lower bands of metal. These lock pin sleeves may be used to insert a lock pin therethrough to lock the mast in an upright position. Likewise, the hinge pin of hinge 72 may be removed so that upper mast portion 68 may be completely disassembled from lower mast portion 70.

Also depicted in FIG. 3 in articulation joint 60. As shown therein, articulation joint 60 includes a universal joint 122 which provides articulation between forward pontoon device 6 and the rest of the craft. Universal joint 122 may provide articulation in both the yaw and pitch with respect to the forward sailing direction A. A more detailed description of the universal joint 122 will be provided below.

Also depicted in FIG. 3 is a portion of the rotatable starboard leeboard 92. As shown, starboard leeboard 92 may be rotated into a horizontal position, or rotated to a vertical position by the use of hinge 124. The leeboards also may include hand grips 126 and 128 by which the operator may manipulate the leeboard. In addition, well-known locking means may be used to lock starboard leeboard 92 in one of a plurality of positions. Such locking means are relatively well-known and will not be discussed further.

FIG. 3 also depicts starboard rudder pin 130 which may be coupled to starboard rudder 106. Starboard rudder pin 230 is used to connect a steering control cable (not shown) between starboard rudder 106 and universal joint 122. Thus, as the operator articulates forward pontoon section 6 in yaw, this motion is transmitted via the steering control cable (not shown) to starboard rudder 106. In a like manner, aft dive/climb plane control cables (also not shown) may be coupled between the aft dive/climb planes and universal joint 122.

Pitch articulation of forward pontoon device 6 will be transmitted through the cables to the aft dive/climb planes to control the climbing and diving of the craft. The exact routing of the steerage control cables and the dive/climb plane control cables is not depicted in any of the Figures. This is because such cable routing may be provided in any convenient manner. For example, these cables may be routed within the tubular frame portions 48 and 50, or routed outside of pontoon devices 2 and 4. Those having skill in the field will understand that an infinite number of cable routing schemes may be adapted to control the rudders and dive/climb planes. In addition, those of skill in this field will understand that control cables may be replaced by control rods, gears, cams, and other mechanisms designed to control the rudders and dive/climb planes in response to manipulation of the forward pontoon device 6.

As has been discussed heretofore, the preferred embodiment of the present invention includes features which allow the craft to submerge and later resurface. FIG. 3 depicts some of the structure necessary to accomplish these functions. As is well known in the field, to submerge a buoyant craft it is required to shift ballast such that the craft is no longer buoyant. In the presently preferred embodiment, this means that center pontoons 24, 30, and 36 are flooded with seawater to eliminate their buoyancy. Then, the weight of the craft is such that the craft will submerge, even against the retained buoyancy of outboard pontoons, 22, 26, 28, 32, 34, and 38. For example, according to the presently preferred embodiment, the combined length of the three center pontoons 24, 30, and 36 is 11 feet and has an inside diameter of eight inches and a volume of 3.82 cubic feet, thus displacing 245 pounds of seawater. The weight of these pontoons is approximately 30 pounds. The combined length of the six outboard pontoons 22, 26, 28, 32, 34, and 38 is 22 feet and has an inside diameter of six inches and a volume of 4.31 cubic feet, thus displacing 275 pounds of seawater. The weight of these outboard pontoons is approximately 72 pounds.

The total weight of the craft and all of its parts and hardware is approximately 250 pounds. The total of positive buoyancy of the three center pontoons 24, 30, and 36 is approximately 520 pounds. The pontoons may be configured to provide a reserve buoyancy of 275 pounds. Thus, flooding of the center pontoons 24, 30, and 36 leaves approximately 30 pounds of reserve buoyancy. The average body sailer operator may weigh approximately 18 pounds in seawater, not including any diving gear. Thus, it can be seen that by flooding the center pontoons 24, 30, and 36, the craft will naturally submerge. Such submergence may be assisted by manipulation of forward dive/climb plane 82, rear dive/climb planes 108, 110, and propulsion of electric motors 84, 86, 88, and 90.

Also depicted in FIG. 3 is a pressurized gas cylinder 128 coupled below forward pontoon device 6. Pressurized gas cylinder 128 is used to provide pressurized gas which is directed to center pontoons 24, 30, and 36. The pressurized gas acts to force the water out of these pontoons thus regaining buoyancy in each pontoon. As buoyancy of the pontoons is regained, the craft will naturally resurface. Such resurfacing also may be assisted by dive/climb plane 82, rear dive/climb planes 108, 10, and the propulsion of electric motors 84, 86, 88, and 90.

Turning now to FIG. 6, an operational depiction of the ballast control of one pontoon (for example center pontoon 30) is shown. As graphically depicted in FIG. 6, center pontoon 30 may include air outlet 130, water outlet 131, pressurized gas inlet 132, and water inlet 134. Air outlet 132 may also be used as a water outlet, however a separate water outlet is preferrable.

As shown in FIG. 6*a*, to submerge the craft water inlet 134 and air outlet 130 are opened. As air escapes from air outlet 130, water enters water inlet 134 and gives a negative buoyancy to pontoon 30. Once negative buoyancy is achieved, the craft will submerge. It should be noted that even in the negative buoyancy state a small amount of air will still remain in pontoon 30. This small amount of air contributes the reserve buoyancy of the craft.

When resurfacing, pressurized gas is provided from pessurized gas cylinder 128 to pressurized gas inlet 132 (through hoses to be described below). At the same time, water outlet 131 may be opened to permit water to escape in response to the entry of pressurized air into pontoon 30. As more air enters pontoon 30, positive buoyancy is regained and the craft will naturally resurface.

Returning now to FIG. 3, control devices for operation of the submerging/resurfacing apparatus will be described. First, to submerge the craft the operator opens forward water inlet 134, and rear water inlets 136. Note that FIG. 3 only depicts the starboard water inlet. The following description will be understood to include like structure on port pontoon 24. To open the forward water inlet 134, the operator manipulates forward control rod 140. Likewise, to open rear water inlet 136, the operator manipulates starboard control rod 142. To open the forward air outlet 144, the operator manipulates forward air outlet control rod 146. To open rear air outlet 130 in starboard pontoon 30, the operator manipulates air outlet control rod 150. Thus, with the water inlets 134, 136 open, and with air outlets 144 and 130 open, the pontoons 30 and 36 (and pontoon 24) will lose their buoyancy thus submerging the craft. At the same time, the operator may cause sail 66 to be automatically furled, and upper mast portion 68 to be rotated to a substantially horizontal position. The thus streamlined craft is capable of submerged operations.

To control the craft in a diving attitude, the operator merely pulls upward on hand grip 80, thus articulating forward pontoon device 6 with a downward pitch. This downward pitch is transmitted through universal joint 122, and control cables (or other control transmission devices not shown) to the rear dive/climb planes 108, 110. The movable portion of each rear dive/climb plane is canted in a downward direction with respect to a horizontal plane. This configuration will greatly assist the vehicle in submerging. Also, while the operator pulls upward on and grip 80, dive/climb plane 82 follows and is also canted in a downward position. Thus, positive climbing/diving control is provided to the submerged craft.

Once submerged, all control surfaces such as rudders 104, 106 and the dive/climb planes may be used to provide three-dimensional control to the submerged craft.

Should the operator desire to resurface the submerged craft, he/she first closes water inlets 134, 136 through water inlet control rods 140 and 142. At the same time, the operator will close air outlet valves 144 and 130 through air outlet control rods 146 and 150. Then, the operator opens water outlet valves 152 and 131 (and a like structure on port pontoon 24) through water oulet control rods 156 and 158. With the water outlets open, the operator controls regulation device 160 to allow pressurized gas stored within pressurized gas cylinder 128 to be transmitted through gas tube 162. Gas tube 162 coupled to gas tubes 164 and 166 to carry pressurized gas to forward pontoon 36 and starboard pontoon 30 (and a like structure carries pressurized gas to starboard pontoon 24). Pressurized gas tube 164 carries pressurized gas to gas inlet 168. In a like manner, pressurized gas tube 166 carries pressurized gas to gas inlet 170 on pontoon 30. As was described with reference to FIG. 6, the introduction of pressurized gas into the pontoon forces the evacuation of water through the water outlet, thus regaining buoyancy in the pontoon to resurface the craft.

While the submerging, resurfacing apparatus according to the present invention has been described with what is presently believed to be the most practical embodiment, those of skill in this field will understand that a wide variety of submerging/resurfacing devices may be used with this invention. For example, a pressurized gas cylinder may be stored within any of the pontoons. In addition, a plurality of pressurized gas cylinders may be provided. Also, the pressurized gas devices may also include operator breathing means to allow the operator to breathe pressurized gas while the craft is submerged. Thus, the appended claims are intended to cover all equivalent submerging/resurfacing devices which may suggest themselves to persons of ordinary skill in this field.

Figure 4:
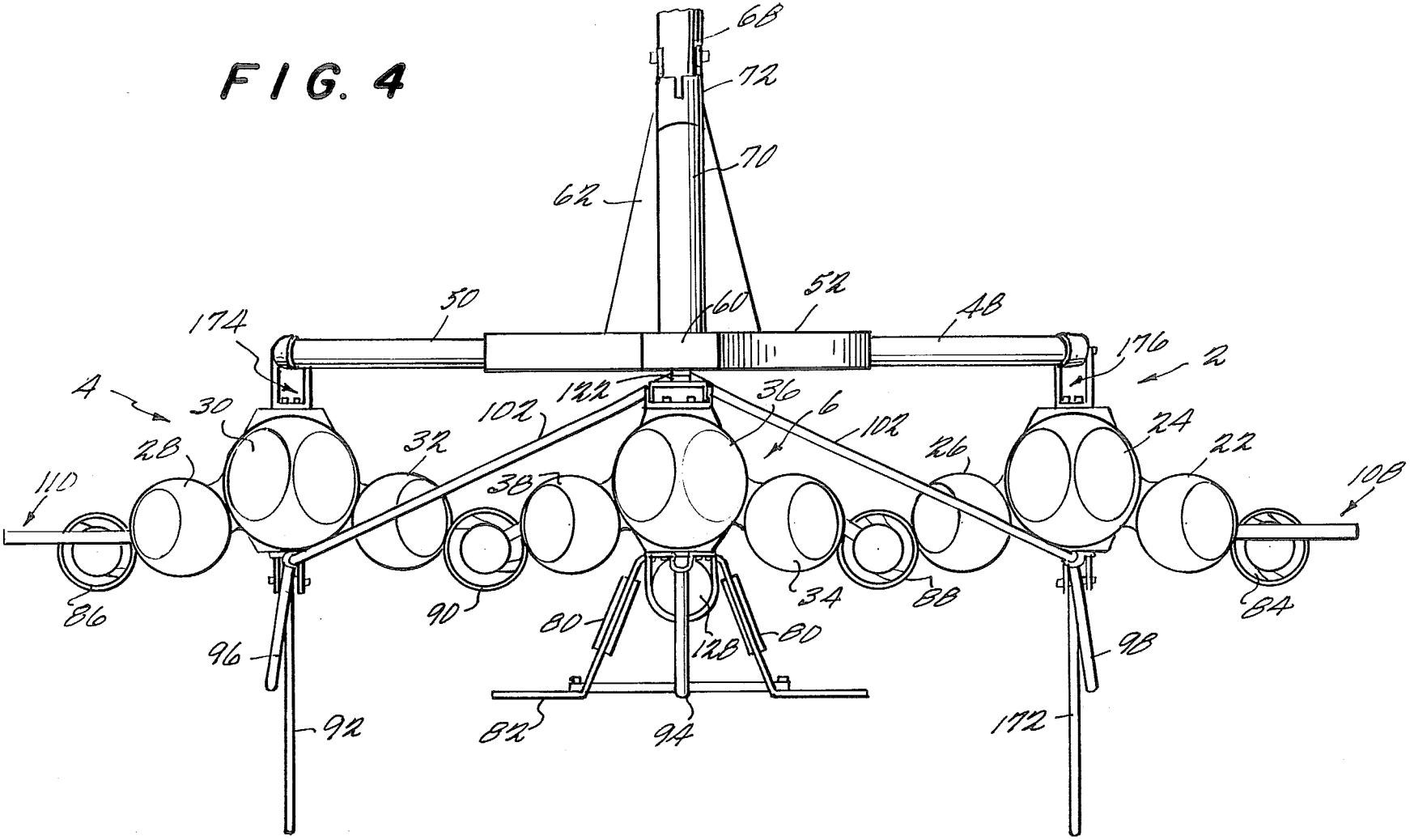
FIG. 4 is a front view of the FIG. 1 embodiment.

FIG. 4 depicts a front view of the invention according to the presently preferred embodiment. A clearer depiction of the configuration of the pontoon bow caps is provided. As can be seen with reference to FIGS. 2, 3, and 4, the bow caps are configured to provide a streamline profile to the water in the forward sailing direction A.

FIG. 4 also depicts the stable architecture of the body sailer craft. Specifically, it is to be noted that the body sailer presents a profile which is very wide compared to the profile depth. This wide profile provides enhanced stability to the craft, while reducing water drag in the forward sailing direction.

FIG. 4 also depicts that port rail 98 and starboard rail 96 are slightly canted outboard of port leeboard 172 and starboard leeboard 92. This slight canting of the rails provides additional protection for the leeboards.

FIG. 4 also depicts couplings 174 and 176 which are used to couple frame member 50 to starboard pontoon device 4 and frame member 48 to port pontoon device 2, respectively. Couplings 174 and 176 may include lock pins, butterfly nuts, bolts, or other means which temporarily couple the frame to the pontoon devices. Couplings 174 and 176 are easily removable so that the body sailer craft may be quickly and easily disassembled. Also, universal joint 122 includes coupling/decoupling means for quickly and easily decoupling forward pontoon section 6 from the frame. Thus, the disassembled craft may include three separate pontoon sections, the frame, and the mast. Thus, it is quite easy to disassemble this craft for storage and/or transportation. Reassembly is likewise made very simple.

FIG. 5 depicts a cross-sectional view of universal joint 122. As described heretofore, universal joint 122 provides yaw and pitch articulation of forward pontoon device 6 with respect to the rear pontoon devices 2 and 4. Likewise, universal joint 122 contains couplings whereby the rudder control cables and the dive/climb control cables may be controlled in accordance with the articulation of forward pontoon device 6.

Universal joint 122 includes an upper portion 180 and a lower portion 182. Upper portion 180 is coupled to an upper frame member 184 through a lock pin 186. Lock pin 186 may be a bolt which is fixed in position with nut 188. Upper washer 190, lower washer 192, and bearing surface 194 are interposed between upper casing 184 and upper portion 180. As can be appreciated, upper portion 180 may be rotated about lock pin 186 with respect to upper casing 184. Thus, forward pontoon portion 6 is rotatable in yaw with respect to frame portion 56.

Through upper portion 180 another lock pin 196 is provided, orthogonal with respect to the plane of the drawing. Lock pin 196 couples upper portion 180 to lower portion 182, as is depicted. In addition, lock pin 196 holds starboard rudder control arm 198. It is to be understood that a port rudder control arm (not shown) is provided on the other side of lock pin 196. To each of the rudder control arms is affixed to rudder control cable, for example 200. As has been discussed heretobefore, rudder control cable 200 is routed to starboard rudder 106. As can be appreciated, when a turn to port is required the operator manipulates forward pontoon portion 6 to cause upper portion 180 to rotate with respect to upper casing 184. As this rotation increases, rudder control arm 198 moves in a direction perpendicular with respect to the plane of the drawing. As rudder control arm 918 moves upward, out of the plane of the drawing, rudder control cable 200 is pulled, thus forcing starboard rudder 106 in a clockwise direction (see FIG. 2) thus turning the craft to port. Likewise, a starboard turn is accomplished in a symmetrical manner.

Lower universal joint portion 182 is rotatable about lock pin 196 with respect to upper portion 180. Lower portion 182 is coupled to forward pontoon 36 with lower casing portion 200. A dive/climb control arm 202 is coupled to lower casing portion 200 through fixing means 204. Fixing means 204 may include a bolt and nut combination, or other known convenient fixing devices.

To the forward end of arm 202 is coupled a down control cable 206. Likewise, to the rear end of control arm 202 is affixed an up control cable 208. Control cables 206 and 208 may be coupled to after dive/climb planes 108, 110 through other control cables (not shown) or other convenient control transmission means.

When the operator desires to submerge the craft, he manipulates the various air and water inlets and outlets, as discussed above. Then, the operator manipulates forward pontoon section 6 such that lower portion 182 rotates with respect to upper portion 180 about lock pin 196. To submerge, the operator manipulates forward pontoon device 6 such that its forward end is moved downard in the direction of arrow B. Since control arm 202 is fixed to pontoon 36, control arm 202 pulls tension on down cable 206, while releasing tension on up cable 208. These forces are transmitted along cables 206 and 208 to cause the movable plane portions of aft dive/-climb planes 108, 110 to be canted in a downward direction with respect to a horizontal plane. This downward cant causes the nose of the craft to point downward, thus submerging the craft. In an opposite manner, when the operator desires to climb, he rotates forward pontoon device 6 so that its forward portion moves in a direction opposite of arrow B. This causes control arm 202 to plane tension on up control cable 208, while releasing tension on down control cable 206. This causes an upward canting of the movable portions of aft dive/climb planes 108, 110 to cause the movable portions to be canted in an upward direction, thus causing the craft to climb.

A careful inspection of FIG. 5 shows that the unique structure of universal joint 122 allows climbing/diving control to be independent of port/starboard steerage control. Specifically, the operator can climb and dive without turning at all. Likewise, the operator can turn port or starboard without any climbing or diving whatsoever. However, the structure of universal joint 122 allows simultaneous control of diving/climbing and port/starboard steerage. For example, the operator can manipulate forward pontoon device 6 to provide simultaneous climbing and turning to port. Likewise, the operator can command simultaneous diving and turning to starboard. Thus, the unique structure of universal joint 122 provides flexible yet simple operational control to the craft.

FIG. 5 also depicts lock pin 210 and lock pin holes 212. The lock pin holes are provided in both lower portion 182 and upper portion 180. By matching lock holes in the upper and lower portions, the operator may insert lock pin 210 therein to temporarily fix lower portion 182 with respect to upper portion 180. Thus, where only surface operations are required lock pin 210 may be used to prevent pitch articulation of forward pontoon device 6 with respect to the rest of the craft. Thus, only port/starboard steering control will be provided by movement of universal joint 122. Another use for lock pin 210 and lock holes 212 is to temporarily fix forward pontoon device 6 at a predetermined dive/-climb angle. Thus, where a long descent is required the operator may temporarily fix forward pontoon portion 6 at a downward angle with respect to frame member 56. This will free the operator from constantly having to control the dive angle of the craft.

Thus, what has been discribed is a uniquely novel sailing device which allows the operator to remain in a submerged or semi-submerged condition. The articulatable forward pontoon device allows steerage control, dive/climb control and provides a submerged hand grip for the operator. The modular nature of the body sailer allows for easy manufacture, quick assembly and disassembly, and convenience of transportation. It is apparent that most of the components for the body sailer may be purchased off-the-shelf, thus further increasing the economic advantages to be derived from the body sailer.

While the present invention has been described with what is presently conceived to be the most practical and preferred embodiments, those of ordinary skill in this field will understand that a wide variety of alternatives and modifications may be made to this invention without departing from the spirit and scope of the appended claims. The appended claims are intended to cover and protect all such equivalent modifications and alternatives. For example, the harness 78 may be used to position the operation such that he/she is positioned above the water. Such may be useful where the water is extremely cold or the operator desires to observe above water activities. In such a case, handlebar or other control means may be attached to forward pontoon device 6 to allow the operator to control the articulation thereof. Thus, all such equivalent structures and modifications are to be understood as being included within the scope of protection afforded by the appended claims.

I claim:

1. Boating apparatus, comprising:

first and second bouyancy means for providing bouyancy to said apparatus;

frame means, coupled to said first and second buoyancy means, for holding said first and second bouyancy means in a spaced apart relationship;

third bouyancy means for providing further bouyancy to said apparatus, said third bouyancy means being connected to said frame means substantially between said first and second bouyancy means but advanced from said first and second bouyancy means in a forward sailing direction of said apparatus;

said frame means includes articulation means coupled to said third bouyancy means to cause said third bouyancy means to be articulatable in yaw with respect to said first and second bouyancy means; and a hand grip, coupled to said third bouyancy means in a submerged position, adapted for providing a submerged hand grip for an operator.

2. Apparatus according to claim 1 wherein said articulation means includes means for causing said third buoyancy means to be articulatable in pitch with respect to said first and second buoyancy means.

3. Apparatus according to claim 1 wherein said frame means includes:

a first frame portion having forward and rearward ends, and coupled to said first buoyancy means;

a second frame portion having forward and rearward ends, and coupled to said second buoyancy means;

a third frame portion coupled between the rearward ends of said first and second frame portions;

collar means for coupling together the forward ends of said first and second frame portions; and a fourth frame portion coupled between said collar means and said articulation means.

4. Apparatus according to claim 3 wherein said collar means includes means for holding a mast.

5. Apparatus according to claim 4 further including a mast adapted to be coupled to said mast holding means, said mast having hinge means to cause an upper portion of said mast to be articulatable with respect to a lower portion of said mast.

6. Apparatus according to claim 1 further including steering means for steering said apparatus, said steering means including:

rudder means, coupled to said frame means at a side opposite said third buoyancy means, for providing steerage to said apparatus;

control means, coupled to said third buoyancy means, to cause said rudder means to provide steerage to said apparatus in response to manipulation of said grip by said operator; and steering control transmission means, coupled between said rudder means and said control means, for transmitting steerage control from said grip to said rudder means.

7. Apparatus according to claim 1 further including submerging/resurfacing means for causing said apparatus to be completely submerged and later resurfaced, said submeging/resurfacing means including:

pressurized gas storage means, coupled to said third buoyancy means, for providing pressurized gas to said first, second, and third buoyancy means to cause said first, second and third buoyancy means to regain buoyancy and resurface the submerged apparatus; and in each of said first, second and third buoyancy means:

water inlet means for allowing water to enter said each buoyancy means to cause it to lose buoyancy to cause said apparatus to become completely submerged;

air outlet means for allowing air to escape from said each buoyancy means in response to the entry of said water;

pressurized gas inlet means for providing pressurized gas from said pressurized gas storage means to said each buoyancy means; and water outlet means for allowing water to exit said each buoyancy means in response to the entry of pressurized gas from said pressurized gas inlet means to cause said each buoyancy means to regain buoyancy.

8. Apparatus according to claim 7 further including first, second, and third motor means coupled to said first, second, and third buoyancy means, respectively, for providing propulsion to said apparatus.

9. Apparatus according to claim 7 further including:

forward diving plane means, coupled to said grip, for controlling diving and climbing of said apparatus; and rear diving plane means, coupled to said first and second buoyancy means, for controlling diving and climbing of said apparatus.

10. Apparatus according to claim 1 wherein said frame means includes operator harness means for providing operator support to cause an operator to be supported in a semi-submerged position between said first and second bouyancy means.

11. Apparatus according to claim 1 wherein said frame means includes:

a first frame portion coupled to said first bouyancy means;

a second frame portion coupled to said second buoyancy means and parallel to said first frame portion;

a third frame portion coupled between rearward ends of said first and second frame portions;

a fourth frame portion coupled to a foreward end of said first frame portion;

a fifth frame portion coupled to a foreward end of said second frame portion;

a collar coupling together foreward ends of said fourth and fifth frame portions; and a sixth frame portion coupled between said collar and said third bouyancy means.

12. Boating apparatus, comprising:

first, second, and third bouyancy means for providing bouyancy to said apparatus, the bouyant apparatus having a waterline on said first, second, and third bouyancy means, each said bouyancy means having a bow end and a stern end;

frame means for coupling together said first, second, and third bouyancy means such that said first and second bouyancy means are held in a parallel, spaced apart relationship, and said third bouyancy means is held substantially in between said first and second bouyancy means but positioned beyond the bow ends of said first and second bouyancy means in a forward sailing direction;

articulation means, coupled to said frame means and said third bouyancy means, for providing yaw articulation of said third bouyancy means with respect to said first and second bouyancy means; and said frame means comprising:

a first frame portion coupled to said first bouyancy means;

a second frame portion coupled to said second bouyancy means and parallel to said first frame portion;

a third frame portion coupled between rearward ends of said first and second frame portions;

a fourth frame portion coupled to a forward end of said first frame portion;

a fifth frame portion coupled to a forward end of said second frame portion;

a collar coupling together forward ends of said fourth and fifth frame portions; and a sixth frame portion coupled between said collar and said third bouyancy means.

13. Apparatus according to claim 12 further including a submerged hand grip coupled to said third buoyancy means below said waterline, adapted for providing a hand grip for an operator of said apparatus.

14. Apparatus according to claim 12 wherein said frame means includes operator support means adapted for supporting an operator in said apparatus between said first and second buoyancy means and substantially adjacent said third buoyancy means stern end so that said operator is positioned above and below said waterline.

15. Apparatus according to claim 12 further including:

first and second rudder means coupled to the stern ends of said first and second buoyancy means, respectively, for providing steerage to said apparatus;

rudder control means, coupled to said third buoyancy means and to said first and second rudder means, for controling said first and second rudder means in response to yaw articulation of said third buoyancy means.

16. Apparatus according to claim 12 wherein said frame means includes mast support means, coupled to said collar, adapted for supporting a mast.

17. Apparatus according to claim 16 further including:

a mast having a lower portion adapted to be coupled to said mast support means, and an upper portion; and hinge means, coupled to said mast upper and lower portions, for providing articulation of said upper portion with respect to said lower portion.

18. Apparatus according to claim 17 wherein said mast further includes retraction means adapted for retracting a sail affixed to said mast so that said sail is in an undeployed position.

19. Apparatus according to claim 12 wherein each of said first, second and third buoyancy means includes a left portion, a center portion, and a right portion, said center portion being larger than said left and right portions.

20. Apparatus according to claim 12 further including submerging/resurfacing means for causing said apparatus to become completely submerged and later resurfaced, said submerging/resurfacing means including:

pressurized gas means, coupled to said third buoyancy means, for providing pressurized gas to said first, second, and third buoyancy means to cause the completely submerged apparatus to resurface; and in each buoyancy means:

water inlet means adapted for allowing water to enter said each buoyancy means to cause it to lose buoyancy to cause said apparatus to become completely submerged;

pressurized gas inlet means to communicate the pressurized gas to an interior of said each buoyancy means; and water outlet means adapted for allowing water inside said each buoyancy means to exit in response to the entry of said pressurized gas to cause said each buoyancy means to regain its buoyancy to cause said completely submerged apparatus to resurface.

21. Apparatus according to claim 20 wherein said articulation means includes means for allowing pitch articulation of said third buoyancy means with respect to said first and second buoyancy means, and further including:

a hand-grip, coupled to said stern end of said third buoyancy means below said water line, adapted for providing a hand grip to an operator whereby said operator can provide said yaw and said pitch articulation to said third buoyancy means; and forward diving/climbing plane means, coupled to said grip, for providing diving/climbing steerage to said apparatus in response to pitch articulation of said third buoyancy means.

22. Apparatus according to claim 21 further including first and second rear diving/climbing means, coupled to said first and second buoyancy means, respectively, for providing diving/climbing steerage to said apparatus in response to pitch articulation of said third buoyancy means.

23. Apparatus according to claim 12 further including first, second, and third electric motor means, coupled to said first, second, and third buoyancy means, respectively, for providing propulsion to said apparatus.

24. Body Sailer apparatus, comprising:

first, second and third buoyancy means for providing buoyancy to said apparatus, a waterline being defined on said first, second, and third buoyancy means when said apparatus is floating in water;

frame means for coupling together said first, second, and third buoyancy means, and for providing operator support to support an operator in a position partially above and partially below said waterline, said frame means coupling said first and second buoyancy means in a spaced apart relationship, and coupling said third buoyancy means in a position between said first and second buoyancy means but advanced therefrom in a forward sailing direction to provide an operator position between said first and second buoyancy means and astern of said third buoyancy means;

articulation means, coupled to said frame means and said third buoyancy means, for providing pitch and yaw articulation of said third buoyancy means with respect to said first and second buoyancy means;

a hand grip, coupled to said third buoyancy means below said waterline, adapted for providing an operator hand grip to an operator in said operator position;

collar means, coupled to said frame means between said third buoyancy means and said first and second buoyancy means, for providing a mast support; and a mast adapted to be coupled to said collar means, and having a hinge to cause an upper mast portion to be pivotable with respect to a lower mast portion.

25. Apparatus according to claim 24 further including submerging/resurfacing means for causing said apparatus to be completely submerged and later resurfaced, said submerging/resurfacing means comprising:

in each said buoyancy means:

water inlet means for permitting water to enter said each buoyancy means to cause it to lose buoyancy to cause said apparatus to become completely submerged;

gas outlet means for permitting gas in said each buoyancy means to exit in response to the entry of water from said water inlet means;

pressurized gas inlet means for permitting pressurized air to enter said each buoyancy means to cause it to regain buoyancy to cause the submerged apparatus to resurface;

water outlet means for permitting water in said each buoyancy means to exit in response to the entry of said pressurized gas;

pressurized gas supply means, coupled to said third buoyancy means, for supplying said pressurized gas to the three pressurized gas inlet means; and control means for providing operator control of said pressurized gas supply means, said water inlet means, said gas outlet means, said pressurized gas inlet means, and said water outlet means.

26. Apparatus according to claim 24 further including steerage control means for controlling steerage of said apparatus, said steerage control means comprising:

first and second rudders coupled to said first and second buoyancy means, respectively; and first and second rudder control means, coupled between said articulation means and said first and second rudders, respectively for controlling movement of said first and second rudders.

27. Apparatus according to claim 24 further including diving/climbing means for controlling diving/climbing of said apparatus, said diving/climbing means comprising:

forward dive/climb plane means, coupled to said hand grip, for controlling diving and climbing of said apparatus;

first and second rear dive/climb planes coupled to said first and second buoyancy means, respectively, for further controlling diving and climbing of said apparatus.

28. Apparatus according to claim 24 wherein said frame means includes:

a first frame portion coupled to said first bouyancy means;

a second frame portion coupled to said second buoyancy means and parallel to said first frame portion;

a third frame portion coupled between rearward ends of said first and second frame portions;

a fourth frame portion coupled to a foreward end of said first frame portion;

a fifth frame portion coupled to a foreward end of said second frame portion;

a collar coupling together foreward ends of said fourth and fifth frame portions; and a sixth frame portion coupled between said collar and said third buoyancy means.

* * * * *